US008185972B2

(12) United States Patent
Beausang

(10) Patent No.: US 8,185,972 B2
(45) Date of Patent: May 29, 2012

(54) HEAD SCARF AND METHOD OF MAKING IT

(76) Inventor: Susan M Beausang, Sarasota, FL (US)

( * ) Notice: Subject to any disclaimer, the term of this patent is extended or adjusted under 35 U.S.C. 154(b) by 204 days.

(21) Appl. No.: 12/799,756

(22) Filed: Apr. 30, 2010

(65) Prior Publication Data

US 2011/0253022 A1 Oct. 20, 2011

Related U.S. Application Data

(62) Division of application No. 11/681,272, filed on Mar. 2, 2007, now Pat. No. 7,707,656.

(51) Int. Cl.
*A41D 23/00* (2006.01)

(52) U.S. Cl. ..... 2/207; 2/202; 2/204; 2/183

(58) Field of Classification Search ..... 2/207, 202, 2/183, 204, 171, 173.5, 182.1, 184, 174, 2/203, 208

See application file for complete search history.

(56) References Cited

U.S. PATENT DOCUMENTS

| | | | | |
|---|---|---|---|---|
| 1,256,205 | A * | 2/1918 | Coolbroth | 2/207 |
| 3,084,346 | A * | 4/1963 | Stelter | 2/84 |
| 3,480,970 | A * | 12/1969 | Gettinger | 2/207 |
| 5,594,956 | A * | 1/1997 | Barrientos | 2/207 |
| 6,735,783 | B2 * | 5/2004 | Phillips | 2/202 |
| 2004/0163162 | A1 * | 8/2004 | Benziger | 2/411 |
| 2005/0034215 | A1 * | 2/2005 | Harrison et al. | 2/207 |
| 2008/0307561 | A1 * | 12/2008 | Grey et al. | 2/202 |

* cited by examiner

*Primary Examiner* — Alissa Tompkins

(57) ABSTRACT

A head scarf with a crown portion and a tail portion is made by stitching together overlying front margin areas of body and lining pieces. This stitching is done along oppositely convex lines on both pieces, and these lines are brought into registry for sewing. One of the pieces is then folded to provide a convex edge of the stitched-together assembly, to place the pieces in face-to-face relation, and to give the assembly a three dimensional forehead-receiving shape in the vicinity of the front margin areas. A semicircular drawstring channel is formed, and the upper regions of the tail portion are drawn together while drawing the crown portion into a shape conforming to a wearer's head.

6 Claims, 3 Drawing Sheets

HEAD SCARF AND METHOD OF MAKING IT

REFERENCE TO RELATED APPLICATION

This is a division of U.S. application Ser. No. 11/681,272, filed Mar. 2, 2007, now issued May 4, 2010 as U.S. Pat. No. 7,707,656.

BACKGROUND AND SUMMARY OF THE INVENTION

This invention relates to head scarves that are suitable for use by all fashion conscious women, and are especially useful to women and children with medical hair loss.

Scarves according to the invention are fashionable, easily put on and taken off, and they can be conveniently rearranged in a variety of styles. For persons without hair, they are particularly comfortable as they can be provided with linings of soft, absorbent material that avoid the discomfort experienced when wearing conventional bandanas and scarfs in hot, humid climates.

Scarves according to the invention have a main body that is made of a fabric usually selected for its appearance, and a lining that is selected for comfort, especially in cases when the wearer does not have hair for medical or other reasons. The main body and the lining are made of fabrics that are flat, planar and flaccid. The scarf has a crown that includes the lining and covers the head, and an optional tail that is adapted to lie behind and hang down from the crown.

One aspect of the invention involves the shape of the crown. The lining and scarf body are connected together in a novel way that enhances the ability of the crown of the scarf to conform to the shape of a wearer's head, and attractively positions the scarfs front margin area that extends across the forehead, to the wearer's ears, and beyond. This advantage is due in part to the structure wherein, in the central longitudinal plane of the scarf, the length of the lining between the front and rear margin areas of the lining is greater, by a differential amount, than the linear distance between the front and rear margin areas of the lining. The front margin area of the lining has end points that are flush with the front margin area of the crown portion of the main body. Preferably, in planes parallel to and spaced from the central longitudinal plane, the lengths of the lining between its front and rear margin areas are greater, by differential amounts, than the linear distance between the front and rear margin areas of the lining, and the differential amounts decrease progressively from a maximum near the central longitudinal plane to about zero in longitudinal planes most distant from the central longitudinal plane.

The forgoing effect is preferably achieved by attaching the front margin area of the main body to the front margin area of the lining by a convex line of stitching that provides the aforementioned differential amounts. This line of stitching desirably has a length (L) and a convexity of 0.005 L to 0.013 L.

In the preferred embodiment of the invention, there is a tail that is adapted to lie behind and hang down from the crown portion. A drawstring channel is located where the tail joins the crown, and a tightening member is located in the drawstring channel for drawing together the upper regions of the tail and for drawing the crown into a shape conforming to a wearer' s head. The tail has a central section that is at least four inches long, and two side sections that lie on opposite sides of the central section and are longer than the central section.

The disclosed scarf has a drawstring channel located where the tail portion joins the crown portion. When the main body and lining are laid out on a planar surface, the drawstring channel has a form that is generally a semicircle having a radius of at least 12 inches. A tightening member, preferably an endless loop made of elastic material, is located in the drawstring channel for drawing together the upper regions of the tail portion and for drawing the crown portion into a shape conforming to a wearer's head.

The invention also includes a method for making a scarf. This method includes the steps of providing a scarf body piece; providing a scarf lining, stitching together the front margin portions of the body and lining pieces to form an assembly of the stitched-together pieces. The stitching is done along lines on both pieces that are convex and are registered with each other, and the stitching is done while the margin portions overlie each other and are extending in opposite directions from their respective pieces. The stitching produces exposed stitch lines on both sides of the sewn-together assembly. One of the pieces is folded to cover one of the exposed stitch lines, to provide a convex edge of the stitched-together pieces, to place the pieces in face-to-face relation, and to give the assembly a three dimensional forehead-receiving shape in the vicinity of the front margin areas. The rear margin area of the scarf lining piece is attached to the scarf body piece.

DETAILED DESCRIPTION

Figure 1:
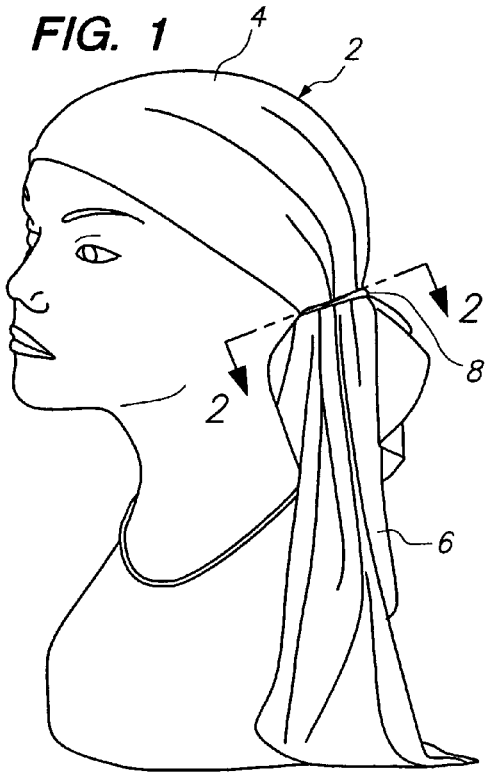
FIG. 1 is a perspective view showing, on a wearer, a scarf made according to the invention.
Figure 2:
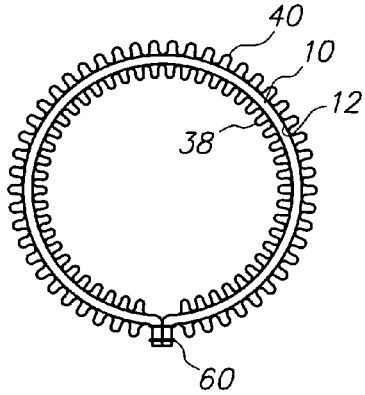
FIG. 2 is a sectional view taken along the line 2-2 in FIG. 1, showing the gathered section that connects the tail to the crown of the scarf.
Figure 3:
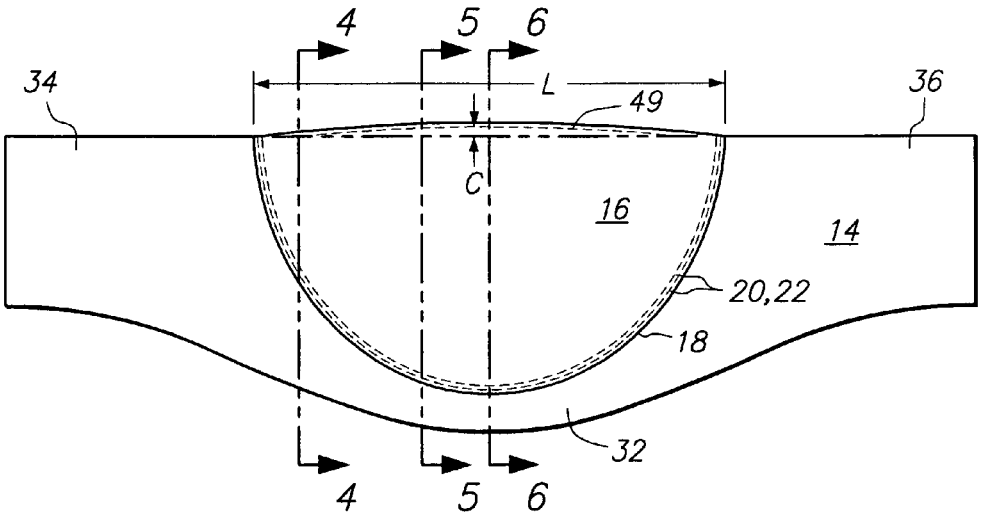
FIG. 3 is a plan view of the scarf, lying on a planar surface before the fabric is gathered into the form shown in FIG. 2.

As shown in FIG. 1, the scarf 2 has a crown 4 that covers a wearer's head, and a tail 6 that is adapted to hang down from the crown. At the rear of the crown 2, the fabric of the scarf is gathered together at 8 by an elastic ring 10 shown in FIG. 2. The elastic ring 10 is in a drawstring channel 12 which is shown in and will be described further in connection with FIG. 3. FIG. 3 shows the shape of the scarf as it would appear when laid on a planar surface, before the elastic ring 10 is placed in the drawstring channel 12. It is formed primarily of a scarf body 14 and a lining 16 which has its margin areas sewn to the body 14. The body 14 and the lining 16 are made of fabrics that are flat, planar and flaccid.

The body 14 is preferably a fabric such as silk or rayon selected for its esthetic properties such as color, design and texture. The lining 16 is a fabric chosen for comfort, especially when the scarf is intended for use by a wearer who has no hair to soften the feel of the scarf on her head. Cotton fabrics are preferred, both for their softness and for their ability to wick perspiration away from the head, especially in hot, humid climates.

The lining 16 has its greatest length, measured longitudinally, in the central longitudinal plane of the scarf The rear edge 18 of the lining is shaped approximately as a semicircle, and it is provided with overedge stitching to deter fraying. Close to and parallel with the edge 18 are two spaced apart lines of stitching 20 and 22 that connect the rear margin area of the lining to the body 14, and form the drawstring channel 12 (FIG. 2) between the body and the lining. As viewed in FIG. 3, the drawstring channel 12 is in the approximate form of a semicircle that has a radius of at least twelve inches.

The front edges of the lining 16 and the underlying front edge of the body 14 are convex and geometrically identical. The front edge of the lining 16 has end points 62 that are flush with the front edge of the crown portion of the main body 15. Convex lines of stitching connect together the front margin areas of the lining 16 and body 14. Quantitatively, the convexity C (FIG. 3) of these elements is 0.005 L to 0.013 L, where L (FIG. 3) is the lateral measurement of the convex lines of stitching. This convexity is preferably established by a continuous curve, but alternatively it can be formed by two or more linear segments.

The manner in which the scarf is assembled, described below in connection with FIGS. 7-11, enhances the ability of the scarf to conform to the shape of a wearer's head, and it facilitates the orientation of the crown as shown in FIG. 1, sloping rearwardly downward from the forehead to points near or below a wearer's earlobes.

Due to the flaccid nature of textile fabric, the scarf is capable of lying flat as shown in FIG. 3, but it actually possesses some depth which can be appreciated when the crown is placed on a wearer's head. This depth is due in part to the fact that, in longitudinal planes, i. e. planes such as those represented by the section lines 4-4, 5-5 and 6-6, the lengths of fabric between the front and rear of the crown are greater than the linear distance between the front and rear of the crown. In this specification, the term "differential amount" is used to describe the difference in any longitudinal plane between (a) the straight line distance between the front and rear of the crown, and (b) the length of the fabric between the front and rear of the crown. When the scarf is laid out as in FIG. 3, the differential amount (excess length) manifests itself in folds and wrinkles. However, when the scarf is placed on a wearer's head, the differential amount provides some slack that provides the crown with a desirable curvature.

Figure 4:
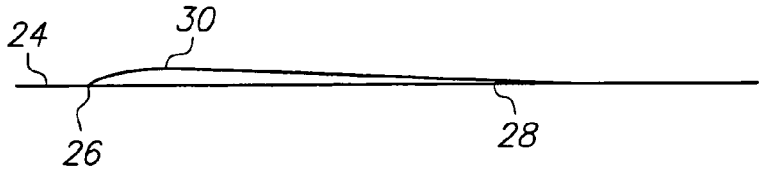
FIGS. 4, 5 and 6 are diagrammatic sectional views of the scarf, as seen along the section lines 4-4, 5-5 and 6-6 in FIG. 2.
Figure 5:
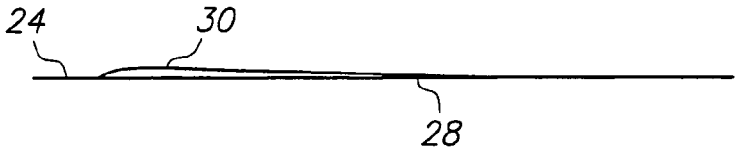
Figure 6:
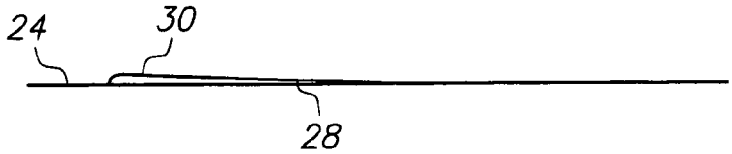

Preferably, the differential amount is greatest in the central longitudinal plane defined by the section line 4-4 in FIG. 3. The differential amounts diminish progressively in longitudinal planes that are laterally outboard of the central plane, until they become zero at the laterally outermost areas of the lining. This will be understood from FIGS. 4, 5 and 6, where the straight lines 24 represent the plane on which the scarf is resting. 26 and 28 represent the front and rear of the crown, and 30 represents the position to which the differential amount in the respective cross-section would permit the crown to be lifted.

The scarf body 14 has hemmed edges and a shape, shown in FIG. 3, that underlies the entirety of and extends beyond the lining 16. The portions of the body 14 that lie beyond the drawstring channel 12 form the tail 6 of the scarf. More specifically, the body 14 has a central tail section 32 that has a length of at least four inches, and two side tail sections 34 and 36. The side tail sections are longer than the central section 32, and they are located on opposite sides of the central section 32.

The scarf may easily be formed into a variety of attractive and fashionable configurations. The tails may cascade freely as shown in FIG. 2, or they can be shortened by tucking their upper regions into the rear of the crown, either inside or extending out through the elastic ring 10. Further styling options are available if the scarf is used with a "scrunchy," an elasticized ring which is a well-known accessory in the fashion and hair care fields. The scrunchy can be placed around the gathered drawstring channel area when the scarf is worn as shown in FIG. 2, or it can be shifted laterally to provide a side ponytail effect. Alternatively, the tails can be tucked to varying degrees into a scrunchy to form a tailless bun or a bun with short tails.

Manufacturing Method

A method of making a scarf according to the invention is illustrated schematically in FIGS. 7-11. Preliminarily, pieces of suitable fabrics are cut to provide a lining piece 38 and a body piece 40. Overedge stitching is applied to the semicircular rear edge 42 of the lining piece, and the edges of the body piece are hemmed, except in the front area where it is to be attached to the lining.

Figure 7:
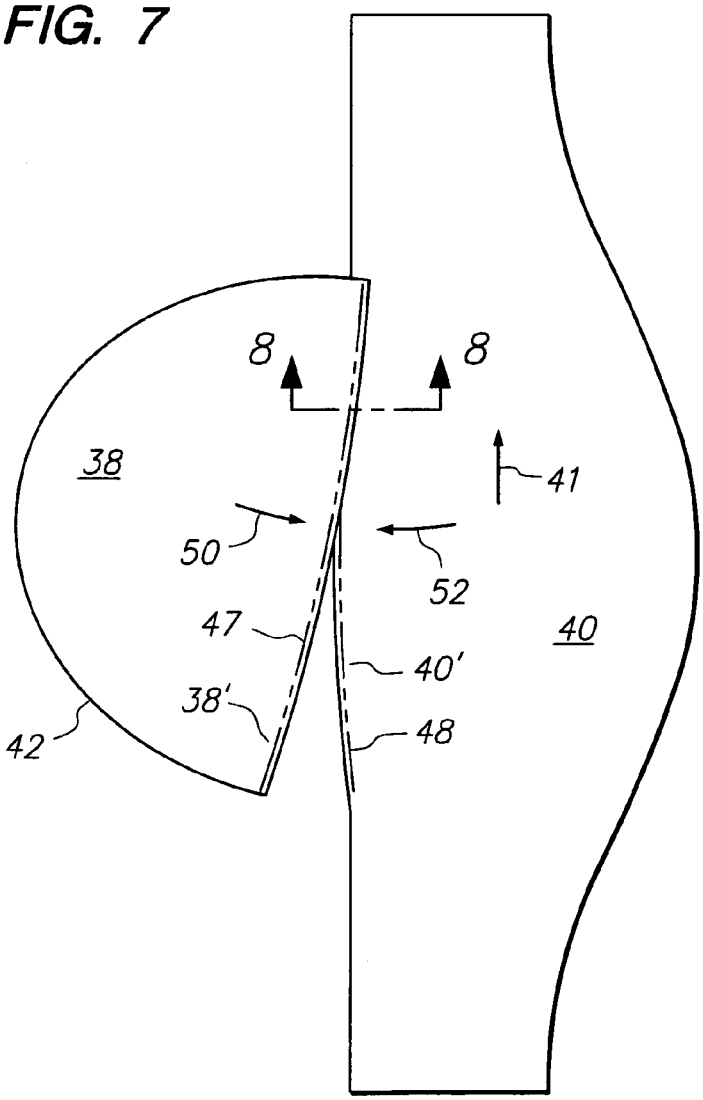
FIG. 7 shows diagrammatically the initial sewing together of the body and lining of the scarf.
Figure 8:
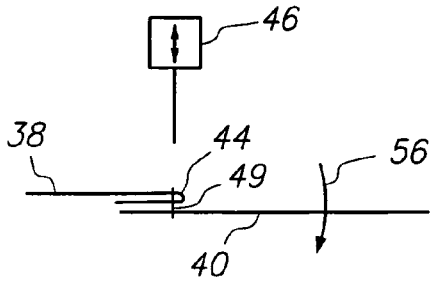
FIG. 8 is a diagrammatic sectional view taken along the line 8-8 in FIG. 7.

As shown in FIG. 8, the lining is folded under at 44, and is placed over a front margin area of the body. Using a sewing machine schematically shown at 46 in FIG. 7, the front margin areas of the pieces 38 and 40 are stitched together. During this step, the front margin areas 38' and 40' of pieces 38 and 40 overlie each other, and these margin areas extend in opposite directions from their respective pieces, i. e., the front margin area 38' is on the right side of the lining piece 38, and the front margin area 40' is on the left side of piece 40. The stitching of FIGS. 7 and 8, rather than being applied in a straight line, is applied along lines that are convex on both pieces. These lines, which lie on the dot-dash lines 47 and 48 in FIG. 7, are registered with each other while the pieces advance in the direction of arrow 41 and the stitching 49 of FIG. 8 is performed. Due to the opposite curvatures of the lines 47 and 48, such registry requires manipulation of the pieces 38 and 40 in the directions of the arrows 50 and 52 during the sewing process. Upon completion of this sewing step, the stitching 49 is exposed on both sides of the sewn-together assembly of pieces 38 and 40.

Figure 10:
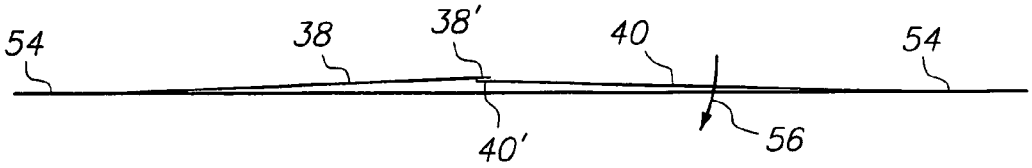
FIG. 10 shows diagrammatically, relative to a reference plane, the body and lining fabric in the central longitudinal plane of the scarf, upon completion of the sewing step illustrated in FIGS. 7 and 8.
Figure 11:
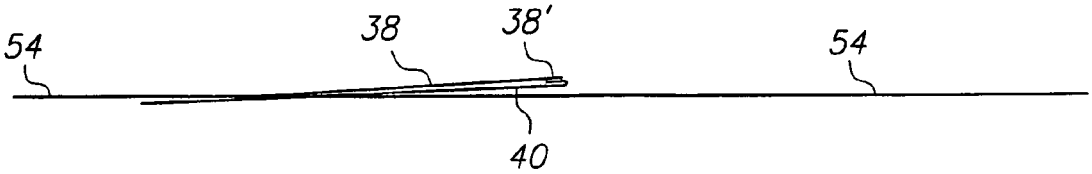
FIG. 11 is similar to FIG. 10, showing the fabric lengths during the sewing step shown in FIG. 9.

FIG. 10 schematically shows the cross section of the assembly formed by the sewing step of FIG. 8. Due to the sewing-together of pieces 38 and 40 along oppositely convex lines, they cannot lie flat and unwrinkled on a flat reference plane represented by the line 54. If taut, they would occupy the positions shown in FIG. 10, each piece being slightly upwardly convex.

Figure 9:
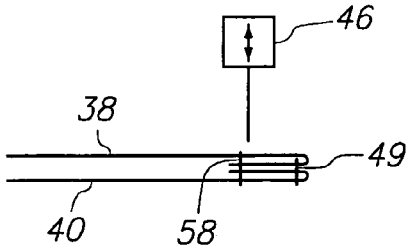
FIG. 9 shows a subsequent step which completes the formation of the headband-like front margin of the scarf.

Next, the body piece 40 is folded in the direction of the arrow 56 shown in FIGS. 8 and 10, bringing the front margin areas of the lining and body pieces to the positions shown in FIG. 9. This covers the stitching 49 that was exposed on the surface of the body piece 40, it provides a convex edge in the stitched-together assembly, it place the pieces in face-to-face relation, and it gives the assembly a three dimensional forehead-receiving shape in the vicinity of the front margin areas. At this stage of the sewing process, the bodies are in mutual overlying/underlying relationship, and they can assume mutual concavities and convexities. A second line of stitching 58 is made as shown in FIG. 9 to complete the front headband-like area of the scarf.

Subsequently, the lines of stitching 20 and 22 shown in FIG. 3 are applied to form the drawstring channel 12 and to secure the rear of the lining piece 38 to the body piece 40. The elastic member 10 is inserted in the channel 12, the fabrics are gathered as shown in FIG. 2, and stitching is applied at 60 (FIG. 2), thus forming the elastic into a closed endless loop.

It will be evident to persons skilled in the art that the invention may take many forms other than the embodiment disclosed in this specification. Accordingly, it is emphasized that this invention is defined primarily by the claims that follow, not by the foregoing descriptions.

The invention claimed is:

1. A method of making a head scarf, comprising the steps of:

providing a scarf body piece made from a flat planar flaccid fabric that has a front margin area and a tail portion, and a scarf lining piece made from a flat planar flaccid fabric that has a front margin area and a rear portion, wherein the lining has a front margin area attached along its length to the scarf body piece, and a rear margin area attached along its length to the scarf body piece, said front margin area of the lining having end points that are flush with the front margin area of the scarf body piece, said lining having its greatest length, measured longitudinally, in a central longitudinal plane stitching together the front margin areas of said scarf body piece and said scarf lining piece to form an assembly of the stitched-together pieces, said stitching being done along lines on both pieces that are convex and are registered with each other, said stitching step being performed while said margin areas overlie each other and are extending in opposite directions from the respective pieces, said stitching step being performed to produce exposed stitch lines on both sides of the sewn-together assembly;

folding at least one of the pieces to cover one of the exposed stitch lines, to provide a convex edge of the stitched-together pieces, to place the pieces in face-to-face relation, and to give the assembly a three dimensional forehead-receiving shape in the vicinity of the front margin areas, and attaching the rear portion of said scarf lining piece to said scarf body piece wherein after the steps of attaching, stitching, and folding are completed a head scarf is formed having a crown for covering a wearer's head and a tail that is located behind said crown and is adapted to hang down from said crown.

2. A method according to claim 1 including the step of drawing together upper regions of the tail portion while drawing the body and lining pieces into a shape conforming to a wearer's head.

3. A method according to claim 1 wherein the stitching is performed along convex lines which have a length (L) and a convexity of 0.005 L to 0.013 L.

4. A method according to claim 1 wherein the rear portion of said scarf lining piece is attached to said scarf body piece by applying a first, generally semicircular line of stitching.

5. A method according to claim 4 including the further step of applying a second line of stitching that is spaced from the first line of stitching to provide a drawstring channel.

6. A method according to claim 5 including the steps of providing a tightening member in the drawstring channel, and drawing together upper regions of the tail portion while drawing the body and lining pieces into a shape conforming to a wearer's head.

* * * * *